US008317478B2

(12) United States Patent
Higo et al.

(10) Patent No.: US 8,317,478 B2
(45) Date of Patent: Nov. 27, 2012

(54) IMPELLER, FAN APPARATUS USING THE SAME, AND METHOD OF MANUFACTURING IMPELLER

(75) Inventors: Asahi Higo, Kiryu (JP); Tetsuya Hioki, Kiryu (JP); Taro Tanno, Kiryu (JP); Mitsuru Ito, Kiryu (JP); Osamu Sekiguchi, Kiryu (JP); Seung-Sin Yoo, Kiryu (JP)

(73) Assignee: Nidec Servo Corporation, Gumma (JP)

( * ) Notice: Subject to any disclaimer, the term of this patent is extended or adjusted under 35 U.S.C. 154(b) by 536 days.

(21) Appl. No.: 12/570,330

(22) Filed: Sep. 30, 2009

(65) Prior Publication Data

US 2010/0086405 A1 Apr. 8, 2010

(30) Foreign Application Priority Data

Oct. 8, 2008 (JP) ..... 2008-261370
Dec. 25, 2008 (JP) ..... 2008-329214
Aug. 18, 2009 (JP) ..... 2009-189278

(51) Int. Cl.
*F04D 29/38* (2006.01)

(52) U.S. Cl. ..... 416/193 R; 416/196 R; 264/336

(58) Field of Classification Search ..... 415/77; 416/179, 189, 193 R, 196 R; 264/318, 334, 264/336
See application file for complete search history.

(56) References Cited

U.S. PATENT DOCUMENTS 4,569,631 A 2/1986 Gray, III
4,569,632 A 2/1986 Gray, III
4,684,324 A 8/1987 Perosino
5,755,557 A * 5/1998 Alizadeh ..... 416/193 R
5,827,046 A 10/1998 Konno et al.
6,241,474 B1 6/2001 Alizadeh et al.
6,554,574 B1 4/2003 Spaggiari
D511,824 S 11/2005 Chen et al.
7,121,799 B2 * 10/2006 Kim et al. ..... 416/186 R
7,946,824 B2 * 5/2011 Iwase et al. ..... 416/223 R
2002/0141871 A1 * 10/2002 Medamaranahally .... 416/193 R
(Continued)

FOREIGN PATENT DOCUMENTS

CN 1118844 A 3/1996
(Continued)

OTHER PUBLICATIONS

Full English language translation of JP 03-061195(U).
(Continued)

*Primary Examiner* — Edward Look
*Assistant Examiner* — Liam McDowell
(74) *Attorney, Agent, or Firm* — Keating & Bennett, LLP

(57) ABSTRACT

An impeller, a fan apparatus, and a method of manufacturing the impeller are provided. The impeller includes a support portion, a plurality of rotor blades, and a joining member. The joining member is a substantially annular member provided to strengthen the rotor blades against influence of a centrifugal force, and extends in a circumferential direction along a circle centered on a central axis so as to join the rotor blades to one another. In each of the rotor blades, a point of intersection of a leading edge of the rotor blade with a radially outer end of the rotor blade is positioned forward, with respect to a rotation direction, relative to a point of intersection of the leading edge with an outside surface of the support portion. The joining member is positioned radially inwards of the radially outer end of each of the rotor blades.

18 Claims, 8 Drawing Sheets

U.S. PATENT DOCUMENTS

| | | | | |
|---|---|---|---|---|
| 2002/0175446 | A1* | 11/2002 | Friery | 264/328.1 |
| 2008/0056899 | A1* | 3/2008 | Jiang et al. | 416/186 R |
| 2008/0101964 | A1 | 5/2008 | Iwase et al. | |
| 2008/0170935 | A1 | 7/2008 | Nakamura et al. | |
| 2010/0068060 | A1* | 3/2010 | Ota et al. | 416/179 |
| 2011/0014052 | A1* | 1/2011 | Hoskins | 416/212 R |

FOREIGN PATENT DOCUMENTS

| | | | |
|---|---|---|---|
| CN | 2702101 | Y | 5/2005 |
| CN | 101173676 | A | 5/2008 |
| JP | 59-183099 | A | 10/1984 |
| JP | 3-61195 | U | 6/1991 |
| JP | 2003-094494 | A | 4/2003 |
| JP | 2008-196480 | A | 8/2008 |
| WO | 2008/072516 | A1 | 6/2008 |

OTHER PUBLICATIONS

Full English language translation of JP 03-061195(U)., Dated Jun. 14, 1991.

* cited by examiner

IMPELLER, FAN APPARATUS USING THE SAME, AND METHOD OF MANUFACTURING IMPELLER

BACKGROUND OF THE INVENTION

1. Field of the Invention

The present invention relates to an impeller having blades with a swept-forward shape and arranged to produce an airflow along a central axis thereof, about which the impeller rotates, a fan apparatus using this impeller, and a method of manufacturing the impeller.

2. Description of the Related Art

Electronic devices such as personal computers or servers are often provided with a cooling fan to cool electronic components within a case thereof. There is a demand for an improvement in the performance of the cooling fan with increasing density of the electronic components within the case. In general, the cooling fans can be divided into two types: exhaust fans designed to expel hot air within the case from the case; and blower fans designed to send cooling air directly to the heated electronic components. In the blower fans, the direction of the airflow, i.e., the direction in which the air is sent, is important.

In a case where the cooling air is sent directly to the heated electronic components, it is desirable that a great quantity of the airflow directed to the electronic components, and the blower fans are suitable for this use.

Impellers having blades with a swept-forward shape are often used in blower fans because the swept-forward blades have a characteristic of preventing the airflow from expanding radially outward when producing the airflow. The term "swept-forward shape" as used herein refers to a blade shape in which a straight line joining the central axis and a point of intersection of a leading edge of each blade with a radially outer end of the blade is positioned forward, with respect to a rotation direction, relative to a point of intersection of the leading edge of the blade with a base of the blade. For example, an impeller used in an axial blower described in JP-A 2008-196480 has blades with the swept-forward shape. The degree to which the aforementioned straight line is positioned forward relative to the aforementioned point of intersection varies.

Rotation of the impeller causes a centrifugal force to be applied to the blades. The centrifugal force is directed in a direction substantially parallel to a radial direction, from the base of each blade where the blade is joined to a support portion. Impellers that are to be rotated at a high speed need to be designed to have sufficient strength, with consideration given to stress imposed on the base of each blade due to the centrifugal force. This influence of the centrifugal force becomes more significant as the speed at which the impeller rotates increases.

The influence of the centrifugal force is great with impellers having blades in which the degree of the forward sweep of the blades is great. Since the radially outer end of each blade of such an impeller is positioned forward relative to the base of the blade with respect to the rotation direction, the centrifugal force produced on entire portions of the blade produces a large moment at the base of the blade. This moment produced at the base of each blade needs be taken into consideration when the impeller is designed. The strength of each blade is lowest at its base because stress concentration occurs at the base of the blade.

Moreover, the aforementioned influence of the centrifugal force may deform the blades so that the radially outer ends of the blades may be displaced radially outward. The radially outward displacement of the radially outer ends of the blades may cause the radially outer ends of the blades to make contact with an inner surface of an outer frame member surrounding the impeller.

As effective countermeasures against the aforementioned influence of the centrifugal force, U.S. D511824, U.S. 2008/0056899, and U.S. Pat. No. 6,554,574 disclose substantially annular joining members arranged to join the blades to one another. In impellers provided with such a joining member, a region radially inward of the joining member joining the blades to one another greatly affects an air flow quantity characteristic of the impeller, whereas a region radially outward of the joining member greatly affects a surge characteristic and a static pressure characteristic of the impeller.

Furthermore, in axial fans, a backward airflow occurs at a gap defined between an inner surface of an outer frame member containing the impeller and the radially outer ends of the blades. This phenomenon manifests itself most strikingly in a surge range which leads to a deterioration in the static pressure characteristic and increased noise levels in the surge range. This problem manifests itself noticeably in cases where the joining member is provided at the radially outer ends of the blades. It is noted that the impeller described in U.S. 2008/0056899 uses sweptback blades, and is different in structure from impellers according to preferred embodiments of the present invention described below.

SUMMARY OF THE INVENTION

Preferred embodiments of the present invention provide an impeller capable of providing stable air currents, with improved characteristics and an ability to reduce the influence of a centrifugal force on blades. Preferred embodiments of the present invention also provide a fan apparatus including the impeller and a method of manufacturing the impeller.

According to a preferred embodiment of the present invention, an impeller including a support portion centered on a central axis is provided. This impeller includes a plurality of blades extending radially outward from an outside surface of the support portion, and arranged to rotate together with the support portion to produce an airflow; and a substantially annular joining member extending in a circumferential direction along an arbitrary circle centered on the central axis, and arranged to join the blades to one another. In each of the blades, a point of intersection of a leading edge of the blade with a blade end of the blade is positioned forward relative to a point of intersection of the leading edge with the outside surface of the support portion with respect to a rotation direction. The leading edge is an edge of the blade positioned most forward with respect to the rotation direction, and the blade end is a radially outer end of the blade. The joining member is positioned radially inward of the blade end of each of the blades.

In the impeller according to this preferred embodiment of the present invention, the plurality of blades extend radially outward from the outside surface of the support portion of the impeller, and in each of the blades, the point of intersection of the leading edge of the blade with the blade end of the blade is positioned forward relative to the point of intersection of the leading edge with the outside surface of the support portion with respect to the rotation direction. Therefore, a centrifugal force produced on entire portions of each blade during rotation of the impeller produces a large moment at a base of the blade. In the impeller according to this preferred embodiment, the substantially annular joining member extends in the circumferential direction about the central axis to join the blades to one another. This joining member contributes to: 1) reducing the moment produced at the base of each blade due to the influence of the centrifugal force, and 2) preventing each blade from being deformed and the radially outer end of each blade from being displaced radially outward. This allows the impeller to blow air stably while reducing the influence of the centrifugal force on its blades. For example, even when the impeller is caused to rotate at a high speed, the moment produced at the base of each blade due to the influence of the centrifugal force can be reduced to ensure stable air blowing.

Moreover, since the substantially annular joining member is arranged radially inward of the radially outer end of each blade, it is possible to allocate different roles to radially inward and outward portions of each blade as divided by the joining member. For the region radially inward of the joining member, the joining member assumes the role of a venturi, and there is accordingly no gap between this virtual venturi (i.e., an inner surface of the joining member) and the portion of each blade which is positioned radially inward of the joining member. Accordingly, this contributes to preventing occurrence of backward airflows in the region radially inward of the joining member which results in most of the backward airflows passing through the region radially outward of the joining member. This allows the portion of each blade which is positioned radially outward of the joining member to primarily serve to prevent the occurrence of the backward airflows when the impeller is caused to operate in a surge range. This leads to an improvement in characteristics of the impeller to enable stable air blowing.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

1. First Preferred Embodiment

Figure 1:
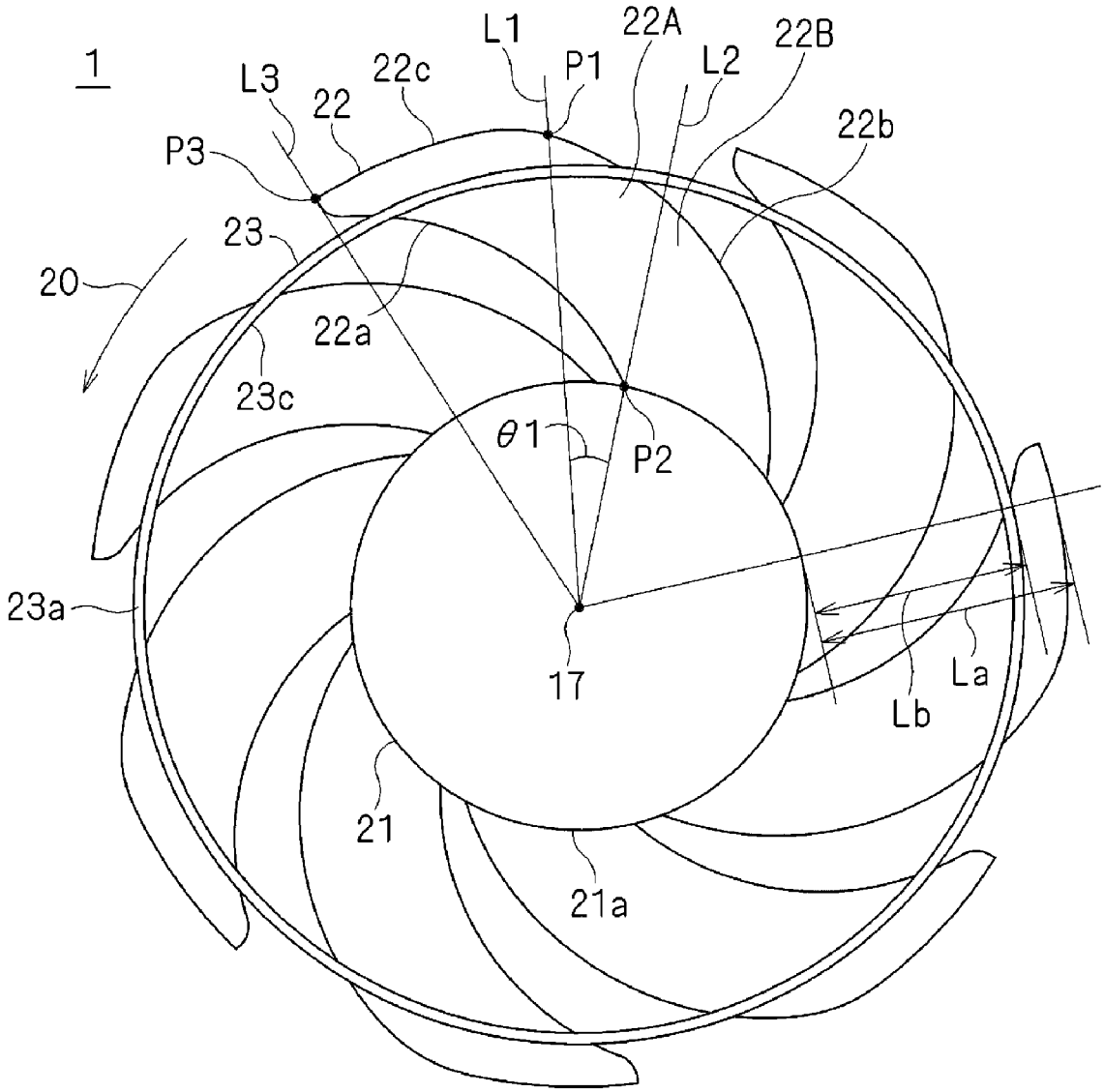
FIG. 1 is a plan view of an impeller according to a first preferred embodiment of the present invention, as viewed from an inlet side along a central axis.
Figure 2:
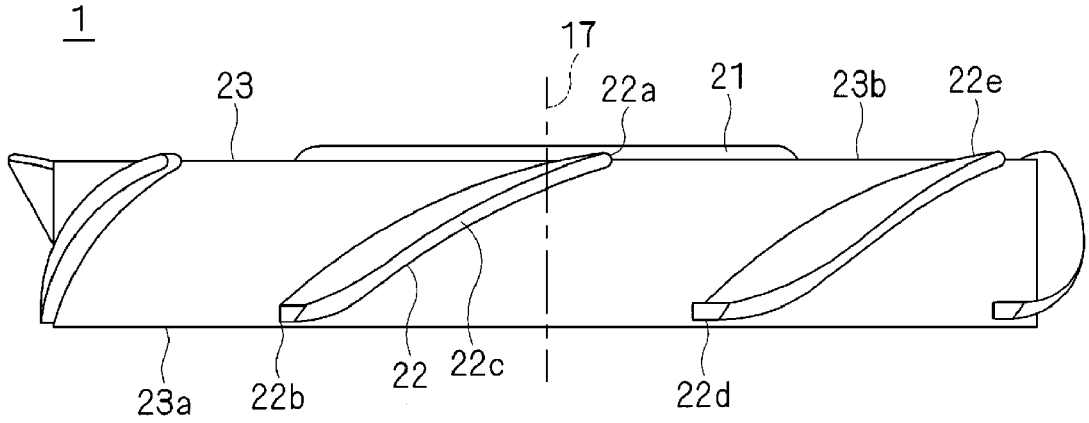
FIG. 2 is a side view of the impeller as illustrated in FIG. 1.
Figure 3:
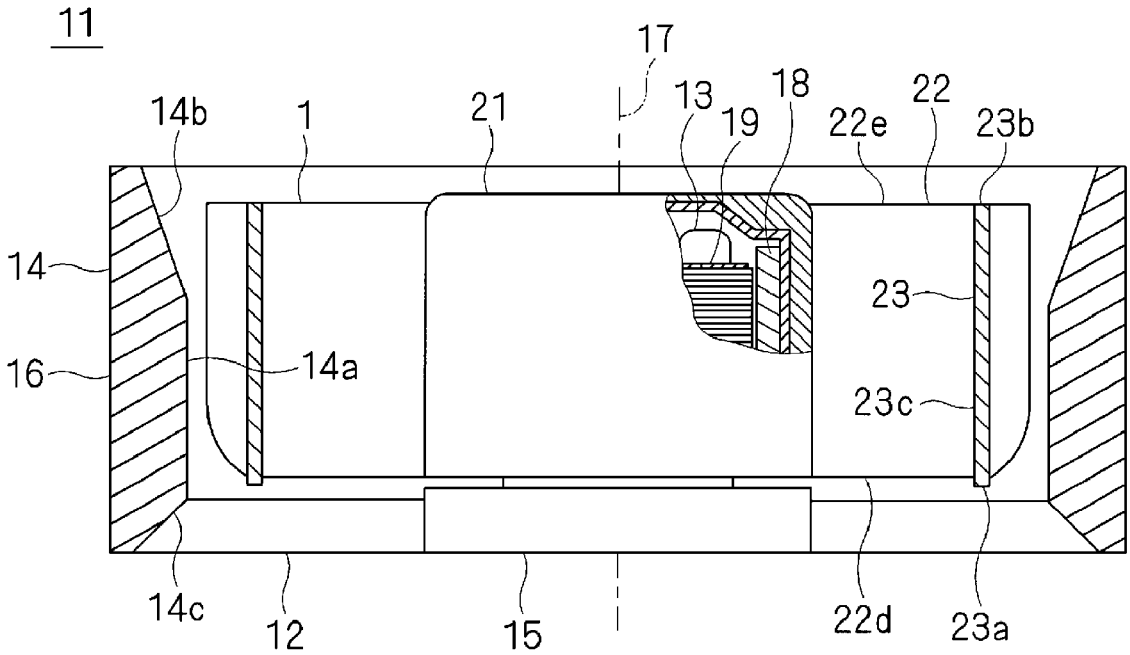
FIG. 3 is a cross-sectional view of a fan apparatus using the impeller as illustrated in FIG. 1.

FIG. 1 is a plan view of an impeller 1 according to a first preferred embodiment of the present invention, as viewed from an inlet side along a central axis 17. FIG. 2 is a side view of the impeller 1 as illustrated in FIG. 1. FIG. 3 is a cross-sectional view of a fan apparatus 11 using the impeller 1 as illustrated in FIG. 1.

Referring to FIG. 3, the fan apparatus 11 using the impeller 1 according to the present preferred embodiment includes the impeller 1, a plurality of stationary vanes 12, a motor 13, an outer frame member 14, and a support member 15. The stationary vanes 12, the outer frame member 14, and the support member 15 define a housing 16 of the fan apparatus 11. Note that in the present preferred embodiment, the stationary vanes 12 and the support member 15 are, for example, provided on an outlet side (i.e., a lower side in FIG. 3) along the central axis 17 of the impeller 1, but could be provided on the inlet side if so desired.

The outer frame member 14, the support member 15, and the stationary vanes 12 are preferably produced by injection molding to form a continuous resin or plastic member, but any other desirable manufacturing method could be used. Molds used in common injection molding processes typically use two mold members, a movable mold and a stationary mold, which are separated from the housing 16 along the central axis 17. This enables mass production of the fan apparatuses 11 to be performed at low cost.

The outer frame member 14 is arranged to surround the impeller 1. The support member 15 is arranged radially inward of the outer frame member 14 to preferably support the motor 13 and a circuit board (not shown) provided with a circuit designed to drive the motor 13, if desired.

The stationary vanes 12 join the outer frame member 14 to the support member 15, extend radially outward from the support member 15, and have a wind receiving surface slanted with respect to a direction along the central axis 17. Examples of the roles of the stationary vanes 12 include diverting airflows produced by rotation of the impeller 1 so that the airflows are collected toward the central axis 17, and directing the produced airflows toward any desired direction, e.g., radially inward or radially outward, for example. The stationary vanes 12 as described above are provided on the outlet side along the central axis 17 of the impeller 1, in order to achieve an efficient collection of air or a directional change of the airflows produced by the rotation of the impeller 1. Note that the stationary vanes 12 may optionally be provided on the inlet side along the central axis 17 of the impeller 1 in other preferred embodiments.

The motor 13 preferably includes a rotor magnet 18 and a stator 19. The rotor magnet 18 is attached to an inside surface of a support portion 21 of the impeller 1. The support portion 21 will be described below. The stator 19 causes torque to be produced in relation to the rotor magnet 18. The motor 13 as described above is contained within the support portion 21 of the impeller 1.

Referring to FIGS. 1 to 3, the impeller 1 preferably includes the support portion 21, a plurality of rotor blades 22, and a joining member 23. The support portion 21 is substantially in the shape of a cup with the central axis 17 as its center, and is arranged to accommodate the motor 13.

The rotor blades 22 extend radially outward from an outside surface 21*a* of the support portion 21 and spaced from one another in a circumferential direction about the central axis 17. Together with the support portion 21, the rotor blades 22 are arranged to rotate in a rotation direction 20 about the central axis 17, resulting in an airflow along the central axis 17. In the present preferred embodiment, a current of air is drawn in from an upper side in FIGS. 2 and 3 (i.e., the inlet side along the central axis 17), and sent out toward the lower side in FIGS. 2 and 3 (i.e., the outlet side along the central axis 17).

The joining member 23 is preferably a substantially annular member provided to strengthen the rotor blades 22 against influence of a centrifugal force, and extends in the circumferential direction along an arbitrary circle centered on the central axis 17 to join the rotor blades 22 to one another. In more detail, the joining member 23 is substantially in the shape of a cylinder extending along the central axis 17.

The rotor blades 22 used in the impeller 1 according to the present preferred embodiment are preferably swept-forward blades. A construction of the swept-forward blades will now be described below. Each of the rotor blades 22 has a leading edge 22*a* and a trailing edge 22*b*. The leading edge 22*a* is an edge of the rotor blade 22 positioned most forward with respect to the rotation direction 20. The trailing edge 22*b* is an edge of the rotor blade 22 positioned most rearward with respect to the rotation direction 20. In each rotor blade 22, a straight line L1 joining the central axis 17 and a point P1 of intersection of the trailing edge 22*b* with a blade end 22*c* positioned at a radially outer end thereof is positioned forward, with respect to the rotation direction 20, relative to a point P2 of intersection of the leading edge 22*a* with the outside surface 21*a* of the support portion 21. Suppose that each rotor blade 22 is divided into two portions, i.e., a forward portion 22A and a rearward portion 22B, at a straight line L2 joining the intersection point P2 and the central axis 17, as viewed in the direction along the central axis 17. Here, the forward and rearward portions 22A and 22B are positioned forward and rearward, respectively, with respect to the rotation direction 20, relative to the straight line L2. Then, in each rotor blade 22, the volume of the forward portion 22A is greater than the volume of the rearward portion 22B. Each rotor blade 22 is made of the same material (i.e., the same type of resin or plastic), and are uniform in specific gravity.

For example, an angle θ1 (i.e., a swept-forward angle) between the straight lines L1 and L2 is set in a range between approximately 10 degrees to approximately 25 degrees (e.g., approximately 15 degrees). This angle range has been determined in view of the following trade-offs. An increase in the swept-forward angle θ1 tends to lead to decreased noise, but at the same time results in a decreased efficiency, necessitating an increase in the rotation rate of the impeller 1.

Note that the degree of the forward sweep of the rotor blades 22 as illustrated in FIG. 1 is not essential to the present invention, and any degree of the forward sweep of the rotor blades 22 can be used in other preferred embodiments of the present invention, as long as each rotor blade 22 is a swept-forward blade, in which a straight line L3 joining the central axis 17 and a point P3 of intersection of the leading edge 22*a* with the blade end 22*c* of the rotor blade 22 is positioned forward, with respect to the rotation direction 20, relative to the point P2 of intersection of the leading edge 22*a* with the outside surface 21*a* of the support portion 21.

The number of rotor blades 22 is preferably seven, for example. This number has been determined in view of the following trade-offs. Smaller numbers of rotor blades 22 tend to lead to decreased noise, but at the same time result in decreased static pressure. Note, however, that the number of rotor blades 22 is not limited to seven in other preferred embodiments and any desirable number of rotor blades can be used.

As described above, the degree of the forward sweep of the rotor blades 22 of the impeller 1 according to the present preferred embodiment is substantial. Therefore, the centrifugal force produced on entire portions of each rotor blade 22 during the rotation of the impeller 1 produces a large moment at a base of the rotor blade 22. In the impeller 1 according to the present preferred embodiment, however, the joining member 23, which is substantially in the shape of a cylinder with the central axis 17 for its center, is provided to join the rotor blades 22 to one another, so that the rotor blades 22 are unified and strengthened to reduce the moment produced at the base of each rotor blade 22 due to the influence of the centrifugal force, and at the same time to prevent each rotor blade 22 from being deformed and the blade end 22*c* of each rotor blade 22 from being displaced radially outward. This enables stable air blowing while reducing the influence of the centrifugal force on the rotor blades 22, despite the fact that the degree of the forward sweep of the rotor blades 22 is so substantial. For example, it enables stable air blowing even when the impeller 1 is rotated at a high speed, while reducing the moment produced at the base of each rotor blade 22 due to the influence of the centrifugal force.

Moreover, since the substantially annular joining member 23 is arranged radially inward of the blade end 22*c*, which is positioned at the radial periphery of each rotor blade 22, it is possible to allocate different roles to radially inward and outward portions of each rotor blade 22, as divided by the joining member 23. For the region radially inward of the joining member 23, the joining member 23 assumes the role of a venturi, and there is accordingly no gap between this virtual venturi (i.e., an inner surface 23*c* of the joining member 23) and that portion of each rotor blade 22 which is positioned radially inward of the joining member 23. This contributes to preventing the occurrence of backward airflows in the region radially inward of the joining member 23. This results in most of the backward airflows passing through the region radially outward of the joining member 23. This allows that portion of each rotor blade 22 which is positioned radially outward of the joining member 23 to primarily serve to prevent the occurrence of the backward airflows, when the impeller 1 is caused to operate in a surge range. This leads to an improvement in characteristics of the impeller 1 to enable stable air blowing.

Furthermore, since the joining member 23 is substantially in the shape of a cylinder extending axially along the central axis 17, entire portions of each rotor blade 22 along the central axis 17 can be strengthened securely against the influence of the centrifugal force.

Next, the radial position at which the joining member 23 should be provided on the rotor blades 22 will now be discussed below. In order to make the joining member 23 serve to strengthen the rotor blades 22 efficiently against the influence of the centrifugal force, it is desirable that the joining member 23 be provided somewhere between about a radial midpoint of each rotor blade and the radially outer end thereof. In addition, consideration needs be given to issues such as an increase in noise due to interference between the joining member 23 and the airflows produced by the rotation of the rotor blades 22. Thus, the present inventors constructed five types of samples G1 to G5 of the impeller 1, in which the joining member 23 is provided at different radial positions, and made experiments using these samples.

Figure 4:
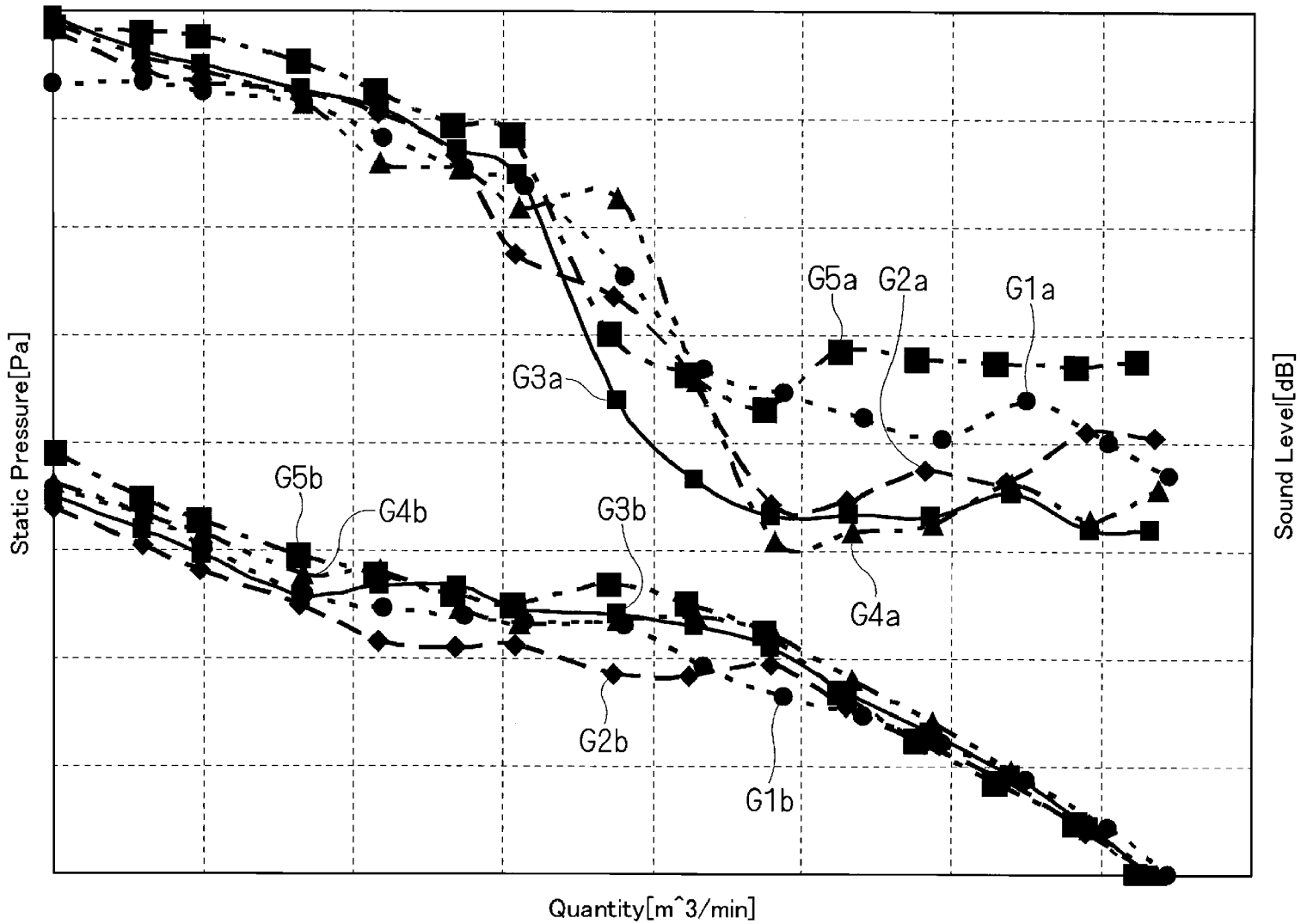
FIG. 4 is a characteristic graph showing relationships between air flow quantity and noise level and between the air flow quantity and static pressure, regarding a plurality of impellers including the impeller as illustrated in FIG. 1, in which the joining member is provided at different radial positions.

FIG. 4 is a graph showing relationships between the air flow quantity and the noise level and between the air flow quantity and the static pressure, regarding samples G1 to G5 of the impeller 1, in which the joining member 23 is provided at different radial positions. In the graph of FIG. 4, a horizontal axis represents the air flow quantity (measured in cubic meters) per minute, a left-hand vertical axis represents the static pressure (measured in pascals), and a right-hand vertical axis represents the noise level (measured in dB). Lines G1*a* to G5*a* represent measured results about the relationship between the air flow quantity and the noise level for the five types of samples G1 to G5, whereas lines G1*b* to G5*b* represent measured results about the relationship between the air flow quantity and the static pressure for the five types of samples G1 to G5. Here, a blade length La of each rotor blade 22 as measured along the radial direction (see FIG. 1) is used as a reference. Then, for the samples G1 to G5, the radial distance Lb from the outside surface 21*a* of the support portion 21 to the joining member 23 (see FIG. 1) is set to 50%, 70%, 80%, 90%, and 100%, respectively, of the blade length La.

Focusing on the relationship between the air flow quantity and the noise level as indicated in the graph of FIG. 4, it can be seen that the samples G1 and G5, in which the radial distance Lb of the joining member 23 from the outside surface 21*a* of the support portion 21 is 50% and 100%, respectively, of the blade length La, produce significantly more noise than the samples G2, G3, and G4, in which the aforementioned radial distance Lb is 70%, 80%, and 90%, respectively, of the blade length La. The sample G1 produces increased noise presumably because the radial midpoint of each rotor blade 22 contributes greatly to producing the airflows, and therefore the joining member 23 provided thereat causes increased interference with the airflows. Meanwhile, the sample G5 produces increased noise presumably because the provision of the joining member 23 at the radially outer end of each rotor blade 22 allows the occurrence of the backward airflows, relative to the airflows radially inward of the joining member 23, at a gap between the joining member 23 and the outer frame member 14, and these backward airflows cause the additional noise.

Thus, it has been found that the provision of the joining member 23 at a radial distance of approximately 70% to approximately 90% of the blade length La of the rotor blades 22 as measured along the radial direction from the base of each rotor blade 22 will effectively strengthen the rotor blades by the joining member 23 against the influence of the centrifugal force, while overcoming problems such as the increase in noise due to the provision of the joining member 23. More preferably, the joining member 23 is provided at a radial distance of approximately 80% of the blade length La from the base of each rotor blade 22. This will strengthen the rotor blades 22 with the joining member 23, while maintaining the performance at close to a maximum efficiency level, where the greatest air flow quantity is achieved for a given power consumption.

Further, in the present preferred embodiment, the support portion 21, the rotor blades 22, and the joining member 23 of the impeller 1 are preferably produced by injection molding to form a continuous resin or plastic member. Molds used in injection molding are primarily composed of two mold members, a movable mold and a stationary mold, which are separated from the impeller 1 along the central axis 17.

Since the support portion 21, the rotor blades 22, and the joining member 23 of the impeller 1 are preferably made of a resin or plastic material as described above, it is possible to produce the impeller 1 at low cost by injection molding or the like, and realize weight reduction of the impeller 1. In addition, since the support portion 21, the rotor blades 22, and the joining member 23 of the impeller 1 are preferably produced by the injection molding to form a continuous resin or plastic member, it is possible to mass-produce the impellers 1 at low cost.

Referring to FIG. 3, in the present preferred embodiment, increased diameter portions 14*b* and 14*c*, each of which expands gradually with increasing axial distance from the impeller 1, are provided at opening portions of an inner surface 14*a* of the outer frame member 14 on the inlet and outlet sides, respectively, along the central axis 17. Moreover, a radially outward end of each stationary vane 12 is joined to the increased diameter portion 14*c* on the outlet side. According to this construction, when the housing 16 is viewed from above along the central axis 17, a portion of each stationary vane 12 where the stationary vane 12 is joined to the increased diameter portion 14*c* becomes a blind spot. As noted previously, the housing 16 is produced by injection molding using primarily two mold members which are separated from each other along the central axis 17. Accordingly, molten resin or plastic is injected into the aforementioned blind spots, and the resin or plastic is cooled and solidified to define an excessive bulging portion. Noise is sometimes produced when the rotor blades 22 of the rotating impeller 1 pass in the vicinity of the excessively bulging portion.

As such, as illustrated in FIGS. 1 and 3, for example, in the impeller 1 according to the present preferred embodiment, the point P1 of intersection of the blade end 22*c* with the trailing edge 22*b* of each rotor blade 22 and its vicinity preferably assume the shape of a round curve. This contributes to effectively reducing the noise produced when the rotor blades 22 of the rotating impeller 1 pass in the vicinity of the aforementioned excessively bulging portion.

Still further, in the present preferred embodiment, as illustrated in FIGS. 2 and 3, an outlet-side end surface 23*a* of the joining member 23 of the impeller 1 is positioned more on the outlet side than an outlet-side end 22*d* of each rotor blade 22.

Since the rotor blades 22 of the impeller 1 greatly extend radially outward from the support portion 21, the axial positions of the rotor blades 22 tend to vary slightly due to an error in the molding process or the like. Therefore, if the impeller 1 is placed at a temporary depot such that the impeller 1 is supported by the rotor blades 22 during a process of assembling the fan apparatus 11 or the like, the impeller 1 might be so unstable as to cause a trouble in a process of attaching the impeller 1 or the like. In this regard, when the impeller 1 according to the present preferred embodiment is placed at the temporary depot or the like, it is possible to place the impeller 1 on a stand or the like in such a manner that the outlet-side end surface 23*a* of the joining member 23 is in contact with the stand or the like, so that the impeller 1 can be stably placed at the temporary depot or the like. Note that, in other preferred embodiments, an inlet-side end surface 23*b* of the joining member 23 may be arranged to be more on the inlet side than an inlet-side end 22*e* of each rotor blade 22.

Also note that both the outlet-side and inlet-side end surfaces 23*a* and 23*b* of the joining member 23 may be arranged to protrude toward the outlet side and the inlet side, respectively, from the outlet-side and inlet-side ends 22*d* and 22*e*, respectively, of each rotor blade 22. Alternatively, only one of the outlet-side and inlet-side end surfaces 23*a* and 23*b* of the joining member 23 may be arranged to protrude toward the outlet side or the inlet side, respectively, from the outlet-side or inlet-side end 22*d* or 22*e*, respectively, of each rotor blade 22.

Figure 5:
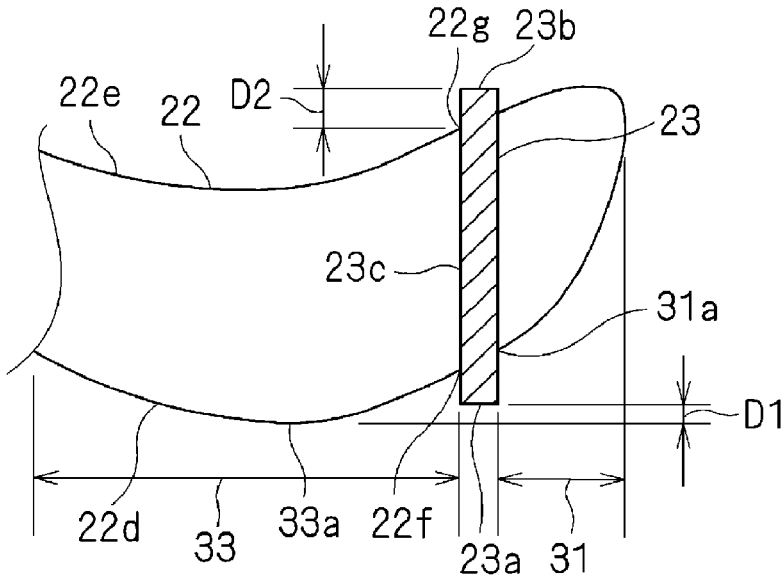
FIG. 5 is a cross-sectional view illustrating the structure of a portion of an exemplary variation of the impeller as illustrated in FIG. 1.
Figure 6:
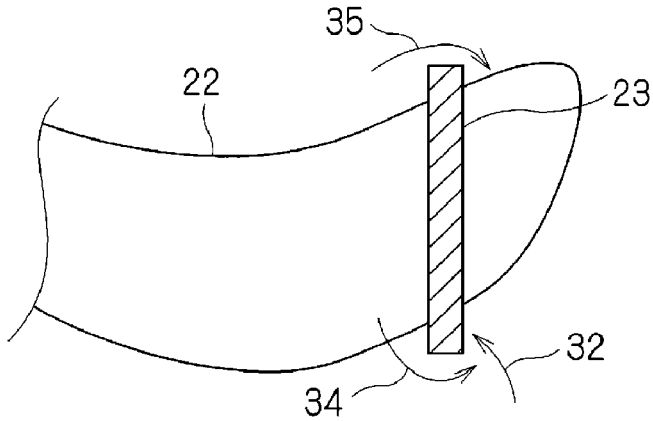
FIG. 6 is a diagram for explaining features of the impeller as illustrated in FIG. 5.

Next, referring to FIGS. 5, 6, and 7, exemplary variations of the impeller 1 according to the above-described preferred embodiment will now be described below. In the exemplary variation as illustrated in FIG. 5, the outlet-side end surface 23*a* of the joining member 23 is positioned more on the outlet side than that portion 31*a* of each rotor blade 22 which is positioned most on the outlet side within that section 31 of the rotor blade 22 which is positioned radially outward of the joining member 23. Therefore, when a backward airflow occurs at the region radially outward of the joining member 23, an outlet-side end portion of the joining member 23 serves to effectively prevent the backward airflow from entering into the region radially inward of the joining member 23 as indicated by an arrow 32 in FIG. 6, for example. This leads to an additional improvement in the characteristics of the impeller 1.

Moreover, in the exemplary variation as illustrated in FIG. 5, in the section 33 of each rotor blade 22 which is positioned radially inward of the joining member 23, the outlet-side end 22*d* of the rotor blade 22 includes a portion 33*a* jutting out toward the outlet side relative to the outlet-side end surface 23*a* of the joining member 23. According to the construction as illustrated in FIG. 5, the portion 33*a* of the outlet-side end 22*d* of the rotor blade 22 in the section 33 juts out toward the outlet side by distance D1 relative to the end surface 23*a* of the joining member 23. This construction makes it possible to increase a blade area in the section 33, which is positioned radially inward of the joining member 23 and greatly contributes to the air blowing within the rotor blade 22, and thereby contributes to an additional improvement in the air blowing performance of the impeller 1.

Furthermore, in the exemplary variation as illustrated in FIG. 5, the outlet-side end surface 23*a* of the joining member 23 is positioned more on the outlet side than an outlet-side end 22*f* of that portion of each rotor blade 22 which intersects with the inner surface 23*c* of the joining member 23. Therefore, the outlet-side end portion of the joining member 23 serves to effectively prevent the airflows toward the outlet side as produced by that section 33 of each rotor blade 22 which is positioned radially inward of the joining member 23 from traveling radially outward across the joining member 23 and then traveling backward toward the inlet side as indicated by an arrow 34 in FIG. 6, for example. This leads to an additional improvement in the characteristics of the impeller 1.

Still further, in the exemplary variation as illustrated in FIG. 5, the inlet-side end 22*e* of each rotor blade 22 is positioned more on the outlet side than the inlet-side end surface 23*b* of the joining member 23, throughout the section 33 of the rotor blade 22 which is positioned radially inward of the joining member 23. According to the construction illustrated in FIG. 5, the end surface 23*b* of the joining member 23 juts out toward the inlet side by distance D2 relative to an inlet-side end 22*g* of that portion of the rotor blade 23 which intersects with the inner surface 23*c* of the joining member 23. This construction allows an inlet-side end portion of the joining member 23 to effectively prevent airflows that are to be drawn from the inlet side of the rotor blade 22 into the region radially inward of the joining member 23 from escaping radially outward over the joining member 23 as indicated by an arrow 35 in FIG. 6, for example. This leads to an additional improvement in the characteristics of the impeller 1.

Figure 7:
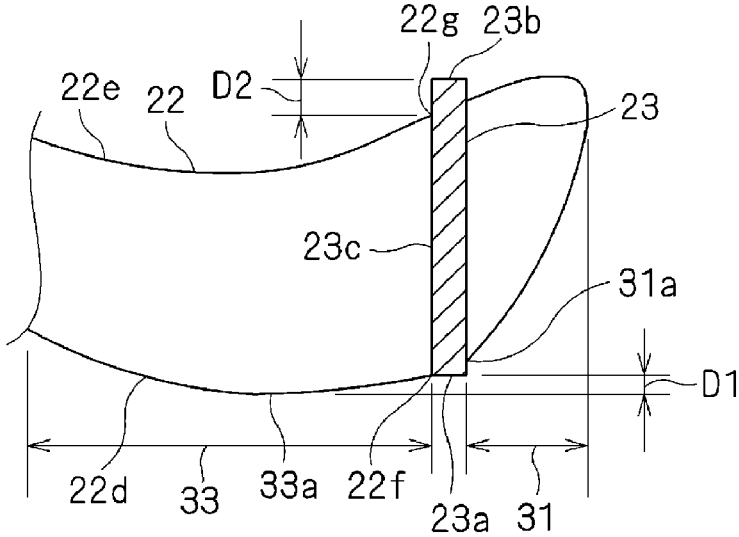
FIG. 7 is a cross-sectional view illustrating the structure of a portion of another exemplary variation of the impeller as illustrated in FIG. 1.

The exemplary variation as illustrated in FIG. 7 is proposed as a further variation of the impeller 1 as illustrated in FIG. 5. In the exemplary variation as illustrated in FIG. 7, the outlet-side end 22*f* of that portion of each rotor blade 22 which intersects with the inner surface 23*c* of the joining member 23 is substantially at the same axial position as the outlet-side end surface 23*a* of the joining member 23. This allows an increase in blade area of the rotor blade 22 in the section 33, which is positioned radially inward of the joining member 23 and greatly contributes to the air blowing within the rotor blade 22, and thereby contributes to an additional improvement in the air blowing performance of the impeller 1.

2. Second Preferred Embodiment

Figure 8:
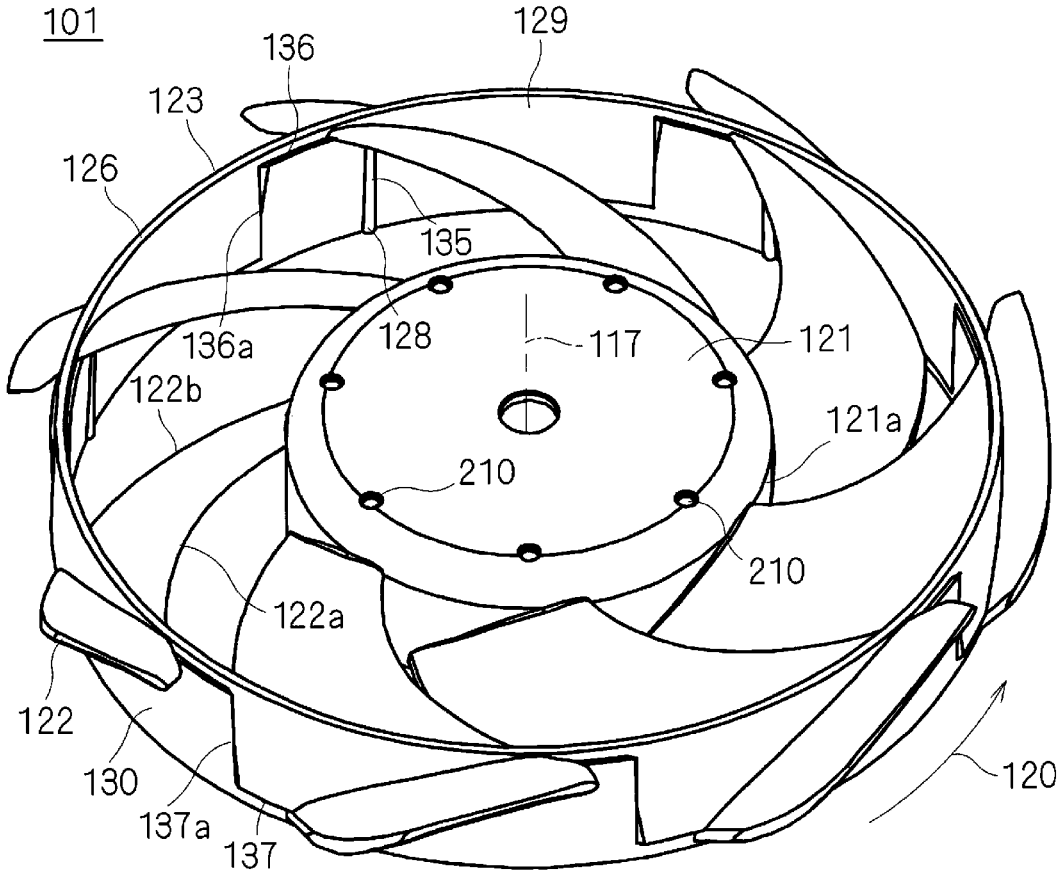
FIG. 8 is a perspective view of an impeller according to a second preferred embodiment of the present invention.
Figure 9:
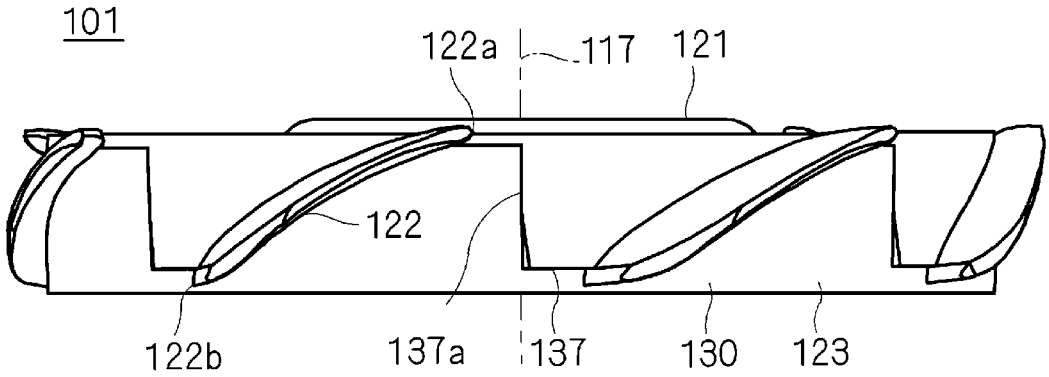
FIG. 9 is a side view of the impeller as illustrated in FIG. 8.
Figure 10:
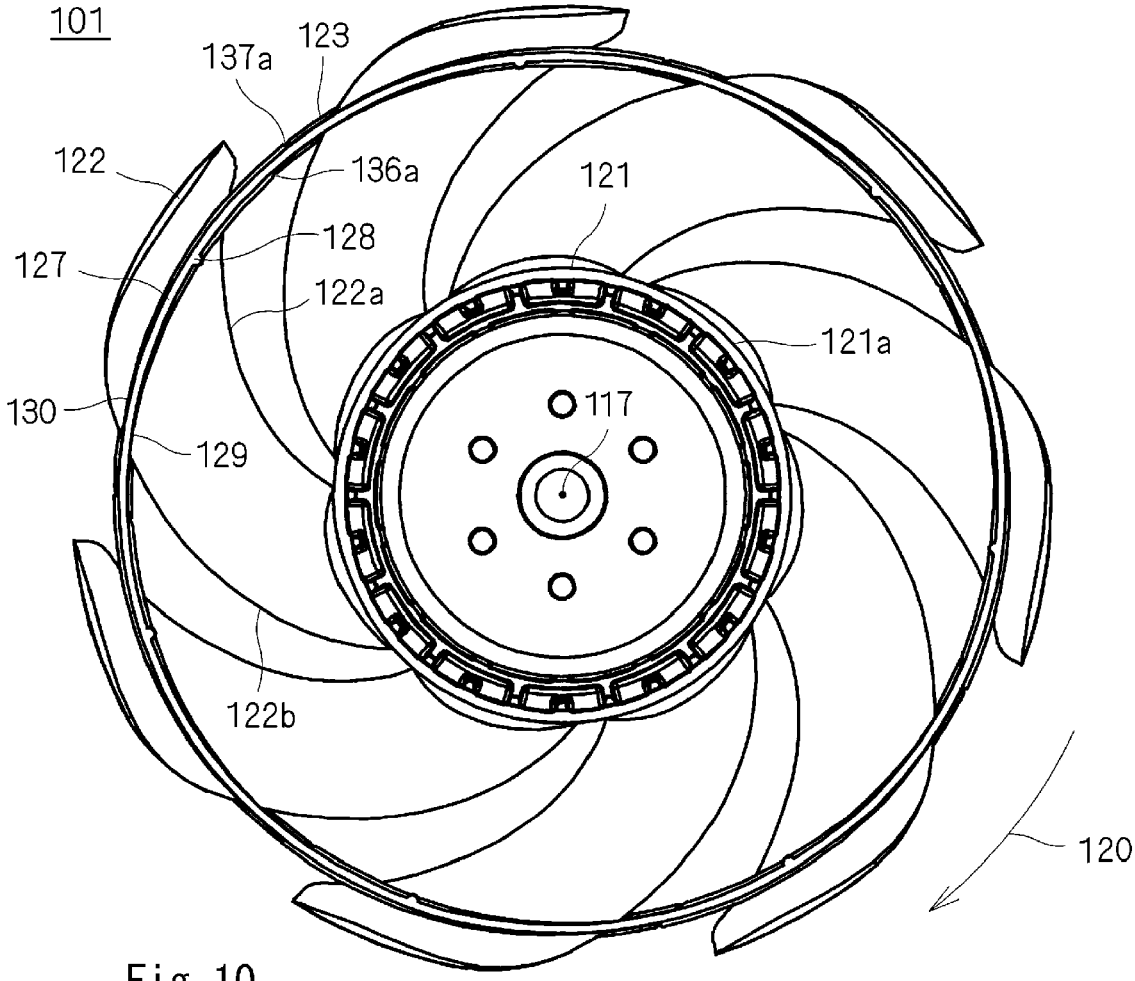
FIG. 10 is a bottom view of the impeller as illustrated in FIG. 8 when viewed from an outlet side along the central axis.
Figure 11:
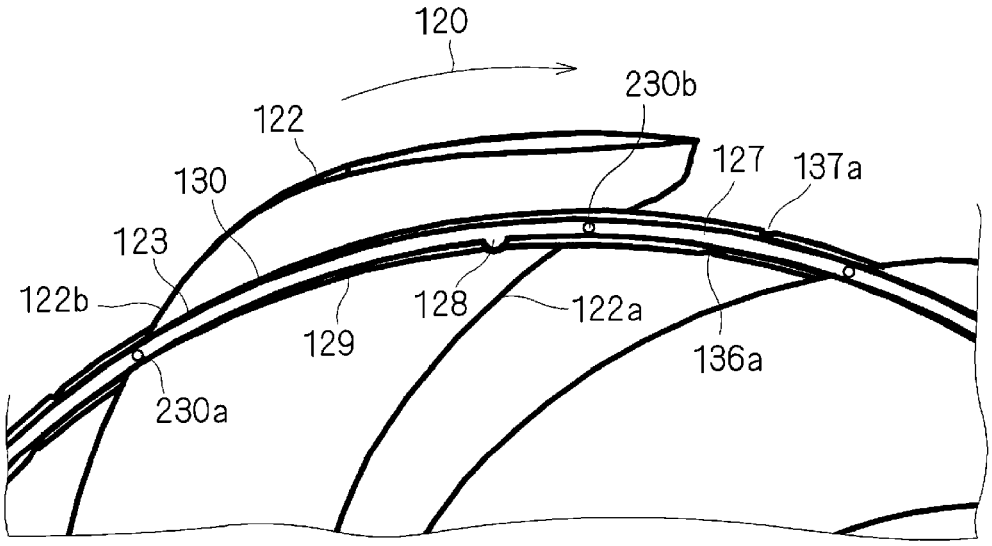
FIG. 11 is an enlarged view of a portion of FIG. 10.
Figure 12:
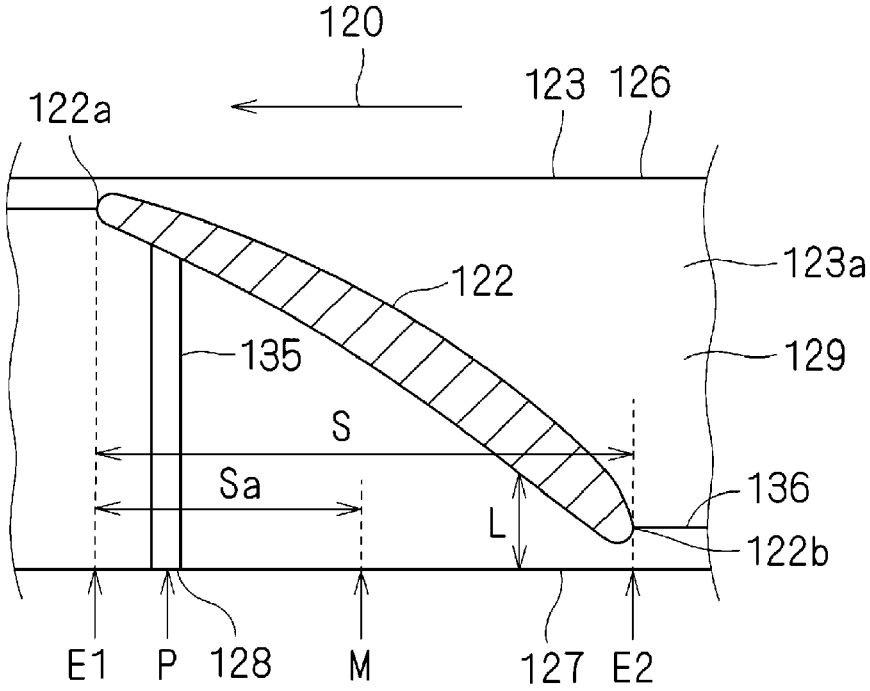
FIG. 12 is a cross-sectional view of a portion of the impeller as illustrated in FIG. 8 where a rotor blade is joined to a joining member.
Figure 13:
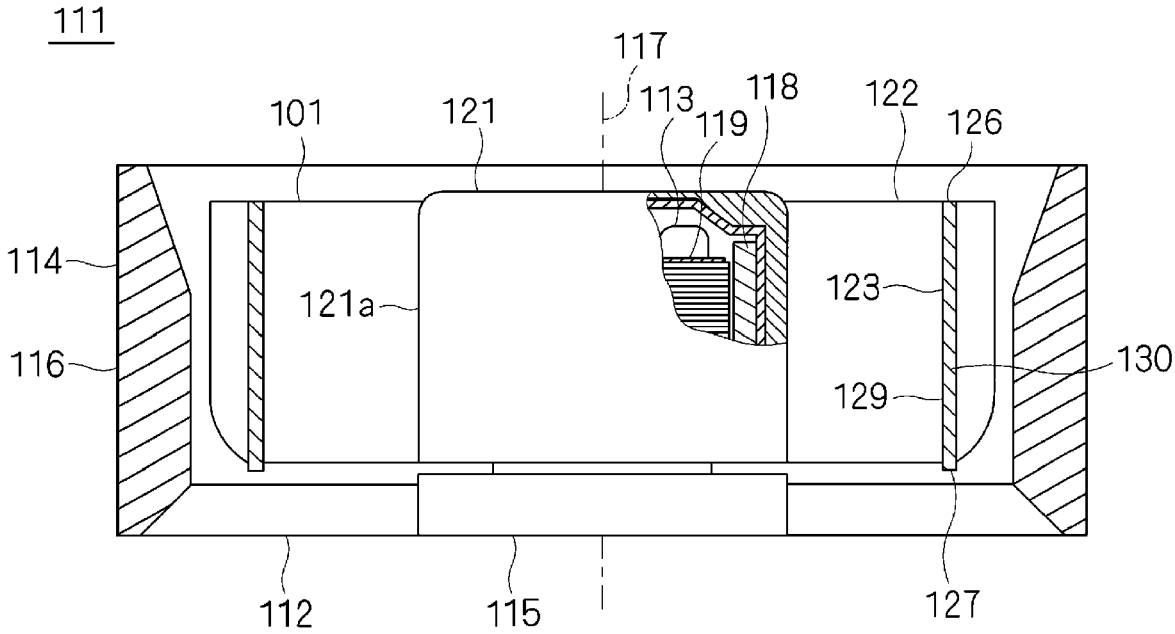
FIG. 13 is a cross-sectional view of a fan apparatus using the impeller as illustrated in FIG. 8.

FIG. 8 is a perspective view of an impeller 101 according to a second preferred embodiment of the present invention, as viewed from an inlet side along a central axis 117. FIG. 9 is a side view of the impeller 101 as illustrated in FIG. 8. FIG. 10 is a bottom view of the impeller 101 as illustrated in FIG. 8, as viewed from an outlet side along the central axis 117. FIG. 11 is an enlarged view of a portion of FIG. 10. FIG. 12 is a view of a portion of the impeller 101 as illustrated in FIG. 8 where a rotor blade 122 is joined to a joining member 123, as viewed radially from an inside. FIG. 13 is a cross-sectional view of a fan apparatus 111 using the impeller 101 as illustrated in FIG. 8.

Referring to FIG. 13, the fan apparatus 111 using the impeller 101 according to the present preferred embodiment includes the impeller 101, a plurality of stationary vanes 112, a motor 113, an outer frame member 114, and a support member 115. The stationary vanes 112, the outer frame member 114, and the support member 115 define a housing 116 of the fan apparatus 111. Note that in the present preferred embodiment, the stationary vanes 112 and the support member 115 are provided on the outlet side (i.e., a lower side in FIG. 13) along the central axis 117 of the impeller 101, but could also be provided on the inlet side if so desired.

The outer frame member 114, the support member 115, and the stationary vanes 112 are preferably produced by injection molding to form an integral continuous resin or plastic member, but any other desirable manufacturing method could be used. Molds used in injection molding processes typically include two mold members, a movable mold and a stationary mold, which are separated from the housing 116 along the central axis 117. This enables mass production of the fan apparatuses 111 at low cost.

The outer frame member 114 is arranged to surround the impeller 101. The support member 115 is arranged radially inward of the outer frame member 114 to support the motor 113 and a circuit board (not shown) provided with a drive circuit designed to drive the motor 113.

The stationary vanes 112 join the outer frame member 114 to the support member 115, extend radially outward from the support member 115, and have a wind receiving surface slanted with respect to a direction along the central axis 117. Examples of the roles of the stationary vanes 112 include diverting airflows produced by rotation of the impeller 101 so that the airflows are collected toward the central axis 117, and directing the produced airflows toward any desired direction, e.g., radially inward or radially outward. The stationary vanes 112 as described above are provided on the outlet side along the central axis 117 of the impeller 101, in order to achieve efficient collection of air or direction change of the airflows produced by the rotation of the impeller 101. Note that the stationary vanes 112 may be provided on the inlet side along the central axis 117 of the impeller 101 in other preferred embodiments.

The motor 113 includes a rotor magnet 118 and an armature 119. The rotor magnet 118 is attached to an inside surface of a support portion 121 of the impeller 101. The support portion 121 will be described below. The armature 119 causes torque to be produced in relation to the rotor magnet 118. The motor 113 as described above is contained within the support portion 121 of the impeller 101.

Referring to FIGS. 8 to 12, the impeller 101 includes the support portion 121, a plurality of (e.g., seven) rotor blades 122, and the joining member 123. The support portion 121 has a cylindrical outside surface 121*a* with the central axis 117 for its center. In the present preferred embodiment, the support portion 121 is substantially in the shape of a cup with the central axis 117 as its center, and the motor 113 is contained within the support portion 121.

The rotor blades 122 extend radially outward from the cylindrical outside surface 121*a* of the support portion 121, to be spaced from one another in a circumferential direction about the central axis 117. Together with the support portion 121, the rotor blades 122 are arranged to rotate in a rotation direction 120 about the central axis 117, resulting in an airflow along the central axis 117. In the present preferred embodiment, a current of air is sucked in from an upper side in FIGS. 8 and 9 (i.e., the inlet side along the central axis 117), and sent out toward the lower side in FIGS. 8 and 9 (i.e., the outlet side along the central axis 117). Thus, a cross-section of each rotor blade 122 taken on a plane perpendicular to the direction in which the rotor blade 122 extends is inclined with respect to a plane perpendicular to the central axis 117, such that a leading edge 122*a* of the rotor blade 122 is positioned more on the inlet side than a trailing edge 122*b* of the rotor blade 122. The leading edge 122*a* is an edge of the rotor blade 122 positioned most forward with respect to the rotation direction 120. The trailing edge 122*b* is an edge of the rotor blade 122 positioned most rearward with respect to the rotation direction 120.

Moreover, the rotor blades 122 used in the present preferred embodiment are preferably rotor blades with the swept-forward shape, and each rotor blade 122 significantly curves forward with respect to the rotation direction 120 as it extends radially outward from its base on the support portion 121. The adoption of this swept-forward shape allows the airflows produced by the rotor blades 122 to be sent out while preventing the airflows from expanding radially outward.

The joining member 123 is a substantially annular member provided to strengthen the rotor blades 122 against influence of a centrifugal force, and extends in the circumferential direction along an arbitrary circle centered on the central axis 117 to join the rotor blades 122 to one another. In more detail, the joining member 123 is substantially in the shape of a cylinder extending along the central axis 117, and joined to that portion of each rotor blade 122 which is positioned closer to a radially outward end than to a radially inward end of the rotor blade 122.

Figure 14C:
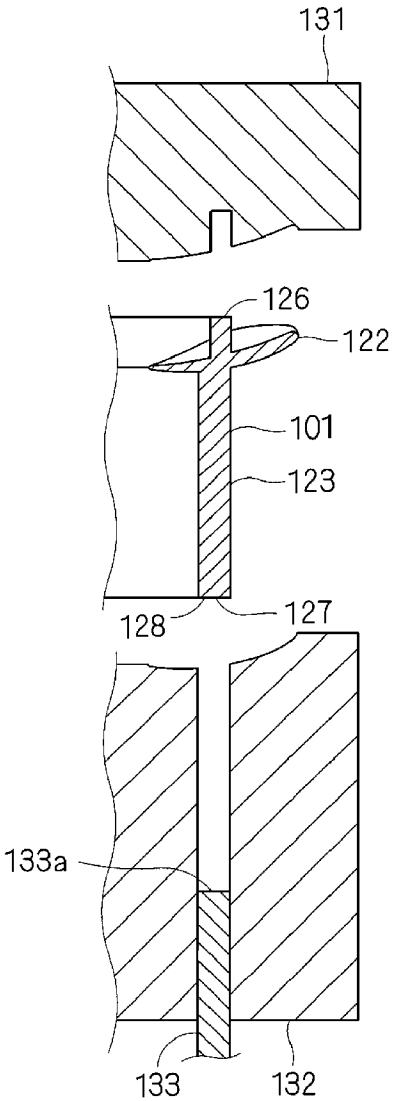
FIG. 14C is a partial cross-sectional view of the molds, and illustrates the situation of the molds as separated from each other after the situation of FIG. 14B.
Figure 14B:
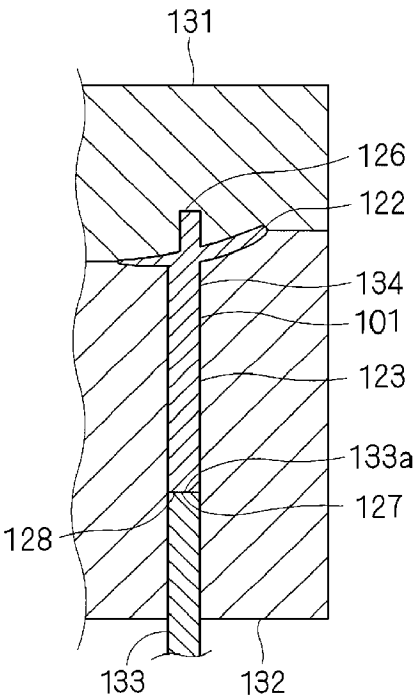
FIG. 14B is a partial cross-sectional view of the molds as illustrated in FIG. 14A, and illustrates the situation of the molds immediately after resin or plastic is injected inside the molds.
Figure 14A:
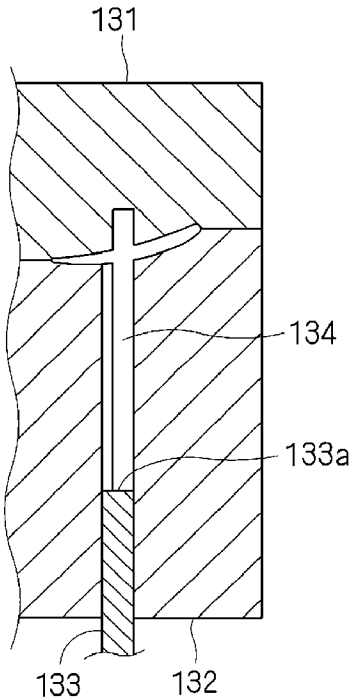
FIG. 14A is a partial cross-sectional view of molds used in a process of manufacturing the impeller as illustrated in FIG. 8, and illustrates a situation of the molds prior to resin or plastic injection.

The impeller 101 is preferably produced by injection molding as an integral continuous resin or plastic member. Referring to FIGS. 14A, 14B, and 14C, in the injection molding process for the impeller 101, a pair of molds 131 and 132 which are to be separated from each other along the central axis 117 (shown in FIG. 8) are used. One of the molds 131 and 132 is a stationary mold, which is fixed at a predetermined position, while the other one of the molds is a movable mold, which is moved toward and separated from the stationary mold along the central axis 117. Note that each of the molds 131 and 132 is typically defined by a plurality of mold components (i.e., insert molds) embedded in a base mold.

At least one of the molds 131 and 132 is provided with a moving portion (sometimes called an ejector pin) 133. The moving portion 133 is arranged to be movable from an inner surface of the mold 131 or 132 in both directions along the central axis 117, and is used to eject the impeller 101 from the mold 131 or 132 after the injection molding process. This moving portion 133 is driven in conjunction with movement of the movable one of the molds 131 and 132 along the central axis 117. In the exemplary illustrations of FIGS. 14A to 14C, the moving portion 133 is provided in the mold 132.

The following description will be made with reference to these exemplary illustrations.

Referring to FIG. 14A, when the molds 131 and 132 are arranged to contact with each other such that a closed space 134 into which a resin or plastic material is injected is defined by the molds 131 and 132, the moving portion 133 is set at such a position that a top surface 133*a* of the moving portion 133 is in alignment with an inner surface of the mold 132, which contributes to defining the closed space 134. Referring to FIG. 14B, in this situation, the resin or plastic material is injected into the closed space 134, so that the impeller 101 can be molded. Next, referring to FIG. 14C, the movable one of the molds 131 and 132 is moved away from the stationary mold, while in conjunction with this movement the moving portion 133 is displaced in such a direction as to project above the inner surface of the mold 132. As a result, the moving portion 133 pushes the impeller 101 in such a direction that the impeller 101 is moved away from the mold 132, so that the impeller 101 and the mold 132 separate from each other.

Since the impeller 101 is pushed by the moving portion 133 out of the mold 132 before the injected resin or plastic material is completely hardened, that portion of the impeller 101 which is pressed by the moving portion 133 may sometimes undergo deformation. Therefore, it is preferable that portions of the rotor blades 122 which would easily be deformed by the pressing by the moving portion 133 and which, if they were deformed, would likely cause significant deterioration in fluid characteristics should not be used as those portions of the impeller 101 which are pressed by the moving portion 133.

Furthermore, the provision of the joining member 123 in the impeller 101 according to the present preferred embodiment results in an increased area where the impeller 101 is in intimate contact with the molds 131 and 132, in the vicinity of the radial periphery of the impeller 101. Accordingly, in order to facilitate the mold release to be accomplished after the injection molding, those portions of the impeller 101 which are arranged to receive the moving portion 133 of the mold 132 need to be provided at the joining member 123 or at both the support portion 121 and the joining member 123.

Therefore, in the present preferred embodiment, as illustrated in FIGS. 10 and 11, at least one increased width portion 128, which defines a receiver for the moving portion 133, is provided in at least one of two surfaces 126 and 127 of the joining member 123 which face in opposite directions along the central axis 117. Each increased width portion 128 is defined by a local increase in the radial width of the surface 126 or 127. In the present preferred embodiment, each increased width portion 128 is provided in the surface 127, which faces in a direction toward which the support portion 121 is open, out of the two surfaces 126 and 127 of the joining member 123. Note that the increased width portions 128 may be provided in the surface 126 instead of the surface 127, or in both the surfaces 126 and 127, in other preferred embodiments.

At each increased width portion 128 provided in the surface 127 of the joining member 123, the radial width of the surface 127 is locally increased to improve the strength, and this prevents the joining member 123 from undergoing deformation due to the pressing by the moving portion 133 at the time of the mold release. Moreover, because the radial width of the surface 127 of the joining member 123 is increased only locally to form each increased width portion 128, it is possible to minimize both a deterioration in the fluid characteristics of the joining member 123 and an increase in mass of the joining member 123 due to the increased radial thickness thereof.

In the present preferred embodiment, at each increased width portion 128 provided in the surface 127, a portion of a radially inward side of the surface 127 is projected radially inward so as to substantially assume the shape of a semicircle, whereby the radial width of the surface 127 is locally increased. In the remaining portions of the surface 127, i.e., excluding the increased width portions 128, the radial width of the surface 127 is substantially constant. Note that, in other preferred embodiments, a portion of a radially outward side of the surface 127 may be projected radially outward to define each increased width portion 128 instead of the radially inward side thereof. Also note that, in other preferred embodiments, portions of both the radially inward and outward sides of the surface 127 may be projected radially inward and outward, respectively, to define each increased width portion 128. Also note that the shape of the projections of the radially inward and/or outward sides of the surface 127, which define each increased width portion 128, is not limited to the semicircle or similar shapes, but may be any of a variety of shapes including a rectangle, a triangle, and other similar shapes, in other preferred embodiments.

The rotor blades 122 have a large area at which they are in intimate contact with the molds 131 and 132. Therefore, when the joining member 123 is pressed by the moving portion 133 of the mold 132 to separate the impeller 1 from the mold 132, a heavy load is likely to be applied to those portions of the joining member 123 at which the joining member 123 is joined to the rotor blades 122.

Accordingly, in the present preferred embodiment, the number of increased width portions 128 is the same as the number of rotor blades 122, and each of the increased width portions 128 is provided at a position within an overlap section S (see FIG. 12), where the surface 127 of the joining member 123, in which the increased width portion 128 is provided, overlaps with one of the rotor blades 122 when viewed in the direction along the central axis 117. Note that the number of increased width portions 128 may be greater or less than the number of rotor blades 122, in other preferred embodiments. For example, the number of increased width portions 128 could be reduced to just one. Also note that each increased width portion 128 may be provided at a position outside of the overlap section S in the surface 127, in other preferred embodiments.

As described above, in the present preferred embodiment, each increased width portion 128 is provided at a position within the overlap section S in the surface 127 of the joining member 123, and it is therefore possible to press the moving portion 133 of the mold 132 against the portions of the joining member 123 at which the joining member 123 is joined to the rotor blades 122, to separate the impeller 101 from the mold. Therefore, when the impeller 101 is pushed out of the mold 132 by the moving portion 133, the separation of the impeller 101 from the mold 132 can be easily achieved without causing a deformation of the rotor blades 122 or the joining member 123.

Moreover, each of the increased width portions 128 is provided within a different one of a plurality of overlap sections S each of which is provided for a separate one of all the rotor blades 122. Therefore, when the impeller 101 is pushed out of the mold 132 by the moving portion 133, the separation of the impeller 101 from the mold 132 can be easily achieved while more effectively preventing a deformation of all the rotor blades 122 and that portion of the joining member 123 at which the joining member 123 is joined to the rotor blade 122.

Next, the position of each increased width portion 128 within the corresponding overlap section S will now be described below. As described above, the cross-section of each rotor blade 122 of the impeller 101 taken on the plane perpendicular to the direction in which the rotor blade 122 extends is inclined with respect to the plane perpendicular to the central axis 117. Therefore, the distance L (see FIG. 12) from the surface 127 to the rotor blade 122 along the central axis 117 varies depending on a circumferential position within the overlap section S of the surface 127 of the joining member 123 in which the increased width portion 128 is provided. Accordingly, the extent of intimate contact between the mold 132, which is provided with the moving portion 133, and a radially inner surface 129 or a radially outer surface 130 of that portion of the joining member 123 which corresponds to the overlap section S also varies depending on the circumferential position within the overlap section S. The aforementioned extent of intimate contact increases as the distance L from the surface 127 to the rotor blade 122 increases.

Accordingly, in the present preferred embodiment, the increased width portion 128 is provided at a position P, which is somewhere between a first end E1 and a middle position M of the overlap section S (i.e., within a subsection Sa). Here, the first end E1 and a second end E2 are two circumferential ends of the overlap section S. The distance L from the first end E1 to the rotor blade 122 along the central axis 117 is greater than the distance L from the second end E2 to the rotor blade 122. The middle position M is circumferentially at the middle of the overlap section S. Note that, in the present preferred embodiment, the first end E1 is the forward end of the overlap section S with respect to the rotation direction 120, while the second end E2 is the rearward end of the overlap section S with respect to the rotation direction 120. Therefore, it is possible to provide the receiver for the moving portion 133 at a position, within the overlap section S of the joining member 123, at which the extent of the intimate contact between the mold 132, which is provided with the moving portion 133, and the radially inner surface 129 or the radially outer surface 130 of that portion of the joining member 123 which corresponds to the overlap section S is great. This makes it possible to easily separate the impeller 101 from the mold 132 while preventing the deformation of the rotor blades 122 and the joining member 123 more effectively when the impeller 101 is pushed out of the mold 132 by the moving portion 133.

More preferably, in the present preferred embodiment, the position P of the increased width portion 128 is circumferentially closer to the first end E1 than to the middle position M, within the section between the first end E1 and middle position M of the overlap section S (i.e., within the subsection Sa). In this case, it is possible to provide the receiver for the moving portion 133 at a position, within the overlap section S of the joining member 123, at which the extent of the intimate contact between the mold 132, which is provided with the moving portion 133, and the radially inner surface 129 or the radially outer surface 130 of that portion of the joining member 123 which corresponds to the overlap section S is greater. This makes it possible to easily separate the impeller 101 from the mold 132 while preventing the deformation of the rotor blades 122 and the joining member 123 still more effectively, when the impeller 101 is pushed out of the mold 132 by the moving portion 133.

Still more preferably, in the present preferred embodiment, the increased width portion 128 is provided in the vicinity of the first end E1. Of the first and second ends E1 and E2 of the overlap section S, the first end E1 has the greater distance L from the rotor blade 122. In other words, in the present preferred embodiment, the increased width portion 128 is provided in the vicinity of a position at which the leading edge 122*a* of the rotor blade 122 is joined to the joining member 123 within the overlap section S, as viewed in the direction along the central axis 117. Therefore, it is possible to provide the receiver for the moving portion 133 in the vicinity of a position, within the overlap section S of the joining member 123, at which the extent of the intimate contact between the mold 132, which is provided with the moving portion 133, and the radially inner surface 129 or the radially outer surface 130 of that portion of the joining member 123 which corresponds to the overlap section S is at its maximum. This makes it possible to separate the impeller 101 from the mold 132 easily while preventing the deformation of the rotor blades 122 and the joining member 123 still more effectively when the impeller 101 is pushed out of the mold 132 by the moving portion 133.

In the present preferred embodiment, the radially inward projection of each increased width portion 128 extends in uniform shape along the central axis 117 continuously from the surface 127 to the surface of the corresponding rotor blade 122. Therefore, it is easy to mold those portions of the joining member 123 at which the increased width portions 128 are provided, by using the mold 131 or 132 (in the present preferred embodiment, the mold 132). In other words, in the present preferred embodiment, a projecting portion 135 which continuously extends in the shape of a ridge along the central axis 117 from the surface 127 to the surface of the rotor blade 122 is provided at a position corresponding to the increased width portion 128 on the inner surface 129 of the joining member 123.

As described above, the cross-section of each rotor blade 122 of the impeller 101 is inclined with respect to the plane perpendicular to the central axis 117, such that the leading edge 122*a* of the rotor blade 122 is positioned more on the inlet side than the trailing edge 122*b* of the rotor blade 122. Accordingly, parting lines 136 and 137, which are defined on the inner and outer surfaces 129 and 130, respectively, of those portions of the joining member 123 of the impeller 101 which are positioned between every two adjacent rotor blades 122, include portions 136*a* and 137*a*, respectively, which extend substantially along the central axis 117 or in a direction inclined with respect to the central axis 117. In the present preferred embodiment, these portions 136*a* and 137*a* extend substantially in the direction along the central axis 117. Note that the term "parting line" as used herein refers to a deformed portion of a resin or plastic molded article which is formed on a surface of the article along a line where two or more molds meet.

In the present preferred embodiment, the portion 136*a* of the parting line 136 formed on the inner surface 129 of the joining member 123 and the portion 137*a* of the parting line 137 formed on the outer surface 130 of the joining member 123 are arranged at mutually different circumferential positions (see FIG. 11).

As described above, the impeller 101 according to the present preferred embodiment is free of the problem of deformation of the joining member 123 of the impeller 101 which might be caused by the joining member 123 being pushed by the moving portion 133 out of the mold 131 or 132 after the injection molding. At the same time, both a deterioration in the fluid characteristics of the joining member 123 and an increase in mass of the joining member 123 due to the increased radial thickness of the joining member 123 are reduced to a minimum level which allows the fan apparatus 111 to produce the airflow stably and efficiently.

Referring to FIG. 8, in the impeller 101 according to the present preferred embodiment, gate marks 210, i.e., remnants of gates used during the injection molding, are preferably arranged in the vicinity of the bases of the rotor blades 122 on an inlet-side surface of the support portion 121. Accordingly, at the time of the injection molding, the resin or plastic material is filled into the joining member 123 through each rotor blade 122. Therefore, a position at which the resin or plastic material arrives last within the joining member 123 is a vicinity of substantially the middle of every two adjacent rotor blades 122 in the joining member 123, and gas burns may occur in the vicinity. The gas burns lead to a deterioration in appearance of the molded article (e.g., short mold, discoloration due to the burn, etc.) and a reduction in strength of the molded article (e.g., a reduction in density of the filled-in resin or plastic, a weld line, etc.), and requires corrective measures to be taken.

An exemplary measure is to arrange vent pins at a plurality of positions on the surface 126 or 127 (in the present preferred embodiment, the surface 127) of the joining member 123 of the impeller 101, and use the vent pins to expel gas produced during the molding out of the mold. In the preferred embodiment illustrated in FIG. 11, for example, for each overlap section S of the surface 127 where one of the rotor blades 122 overlaps with the joining member 123, the vent pins are provided on both circumferential sides of the circumferentially middle position M within the overlap section S (for example, at both ends E1 and E2 of the overlap section S). In FIG. 11, pin marks 230*a* and 230*b* for the vent pins are shown. Accordingly, spaces arranged to permit placement of the vent pins are provided at portions of the molds 131 and 132 which correspond to positions at which the vent pins are arranged.

While preferred embodiments of the present invention have been described above, it is to be understood by those skilled in the art that the present invention is not limited to the above-described preferred embodiments, and that various variations and modifications can be made without departing from the scope and spirit of the present invention.

What is claimed is:

1. An impeller comprising:

a support portion centered on a central axis;

a plurality of blades extending radially outward from an outside surface of the support portion, and arranged to rotate about the central axis together with the support portion to produce an airflow; and a substantially annular joining member extending in a circumferential direction along an arbitrary circle centered on the central axis, and arranged to join the blades to one another; wherein in each of the blades, a point of intersection of a leading edge of the blade with a blade end of the blade is positioned forward, with respect to a rotation direction, relative to a point of intersection of the leading edge with the outside surface of the support portion, the leading edge being an edge of the blade positioned most forward with respect to the rotation direction, the blade end being a radially outer end of the blade;

the joining member is positioned radially inward of the blade end of each of the blades;

the support portion, the blades, and the joining member are defined together as a single continuous monolithic member of molded resin or plastic;

the joining member includes two surfaces facing in opposite directions along the central axis, and at least one of the two surfaces has provided thereon at least one increased width portion defined by an increase in a radial width of the surface; and the at least one increased width portion is a solid member that is provided in an overlapping section where the surface of the joining member on which the increased width portion is provided overlaps with one of the blades when viewed in a direction along the central axis.

2. The impeller according to claim 1, wherein the joining member is provided at a radial distance of approximately 70% to approximately 90% of a total blade length from a base of each of the blades, the total blade length being a dimension of the blade measured along a radial direction.

3. The impeller according to claim 1, wherein in each of the blades, a point of intersection of a trailing edge of the blade with the blade end is positioned forward, with respect to the rotation direction, relative to the point of intersection of the leading edge with the outside surface of the support portion, the trailing edge being an edge of the blade positioned most rearward with respect to the rotation direction.

4. The impeller according to claim 1, wherein, when each of the blades is divided into forward and rearward portions by a straight line joining the central axis and the point of intersection of the leading edge with the outside surface of the support portion, a volume of the forward portion of the respective blade is greater than a volume of the rearward portion of the respective blade, the forward and rearward portions being positioned forward and rearward, respectively, with respect to the rotation direction relative to the straight line.

5. The impeller according to claim 1, wherein, of first and second ends of the overlapping section positioned at circumferential ends thereof, the at least one increased width portion is provided in a vicinity of the first end, the first end being greater than the second end in distance from the blade along the central axis.

6. The impeller according to claim 1, wherein the at least one increased width portion defines a receiver to receive a moving portion of a mold arranged to mold the resin or plastic member, the moving portion being arranged to be movable relative to the mold to push the resin or plastic member out of the mold.

7. The impeller according to claim 1, wherein the joining member is substantially in the shape of a cylinder extending about the central axis.

8. The impeller according to claim 1, wherein the point of intersection of the blade end with the trailing edge of each of the blades, and an adjacent area, have a curve shape.

9. The impeller according to claim 1, wherein an end of the joining member on an outlet side of the impeller along the central axis is positioned more toward the outlet side than a portion of each of the blades positioned most toward the outlet side within a section of the blade which is positioned radially outward of the joining member.

10. The impeller according to claim 1, wherein within a section of each of the blades positioned radially inward of the joining member, an end of each of the blades on an outlet side of the impeller along the central axis includes a jutting portion jutting out toward the outlet side relative to an end of the joining member on the outlet side.

11. The impeller according to claim 1, wherein an end on an outlet side of the impeller along the central axis of a portion of each of the blades which intersects with an inner surface of the joining member is substantially at a same axial position as an end of the joining member on the outlet side.

12. The impeller according to claim 1, wherein an end of the joining member on an outlet side of the impeller along the central axis is positioned more toward the outlet side than an end of a portion of each of the blades which intersects with an inner surface of the joining member on the outlet side.

13. The impeller according to claim 1, wherein an end of the blade on an inlet side of the impeller along the central axis is positioned more toward an outlet side of the impeller along the central axis than an end of the joining member on the inlet side throughout a section of each of the blades which is positioned radially inward of the joining member.

14. The impeller according to claim 1, wherein an end of the joining member on an outlet side of the impeller along the central axis is positioned more on the outlet side than an end of each of the blades on the outlet side.

15. The impeller according to claim 1, wherein there is a plurality of the at least one increased width portions and each of the plurality of the at least one increased width portions is only arranged at positions that overlap the blades.

16. A fan apparatus comprising:

an impeller comprising:

a support portion centered on a central axis;

a plurality of blades extending radially outward from an outside surface of the support portion, and arranged to rotate about the central axis together with the support portion to produce an airflow; and a substantially annular joining member extending in a circumferential direction along an arbitrary circle centered on the central axis, and arranged to join the blades to one another; wherein in each of the blades, a point of intersection of a leading edge of the blade with a blade end of the blade is positioned forward, with respect to a rotation direction, relative to a point of intersection of the leading edge with the outside surface of the support portion, the leading edge being an edge of the blade positioned most forward with respect to the rotation direction, the blade end being a radially outer end of the blade;

the joining member is positioned radially inward of the blade end of each of the blades;

the support portion, the blades, and the joining member are defined together as a single continuous monolithic member of molded resin or plastic; and the joining member includes two surfaces facing in opposite directions along the central axis, and at least one of the two surfaces has provided thereon at least one increased width portion defined by an increase in a radial width of the surface; and the at least one increased width portion is a solid member that is provided in an overlapping section where the surface of the joining member on which the increased width portion is provided overlaps with one of the blades when viewed in a direction along the central axis;

a motor arranged to drive the impeller;

an outer frame member arranged to surround the impeller; and a support member arranged radially inward of the outer frame member to support the motor.

17. The fan apparatus according to claim 16, wherein there is a plurality of the at least one increased width portions and each of the plurality of the at least one increased width portions is only arranged at positions that overlap the blades.

18. A method of manufacturing an impeller including:

a support portion including a cylindrical outside surface centered on a central axis;

a plurality of blades extending radially outward from the cylindrical outside surface of the support portion, and arranged to rotate about the central axis together with the support portion to produce an airflow; and a substantially annular joining member extending in a circumferential direction about the central axis, including two axially exposed surfaces facing in opposite directions along the central axis, and arranged to join the blades to one another; wherein at least one of the two surfaces of the joining member includes at least one increased width portion defined by an increase in a radial width of the surface and at least one decreased width portion defined by a portion of the at least one of the two surfaces that has a smaller radial width than the at least one increased width portion; and the at least one increased width portion is provided in an overlapping section where the surface of the joining member on which the increased width portion is provided overlaps with one of the blades when viewed in a direction along the central axis;

the method comprising the steps of:

injecting resin or plastic into a closed space defined by a pair of molds to be separated from each other along the central axis, to define the support portion, the blades, and the joining member of the impeller integrally as a continuous resin or plastic member; and separating the molds from each other along the central axis, while pushing the at least one increased width portion of the joining member in the resin or plastic member in a direction so as to separate the resin or plastic member from the molds, with a moving portion of the molds arranged to be movable relative to the molds along the central axis.

* * * * *